US005252795A

United States Patent [19]

Su

[11] Patent Number: 5,252,795

[45] Date of Patent: Oct. 12, 1993

[54] TILT SWITCH

[75] Inventor: Su Su, Hsintien, Taiwan

[73] Assignee: Shin Jiuh Corp., Taipel, Taiwan

[21] Appl. No.: 876,514

[22] Filed: Apr. 30, 1992

[51] Int. Cl.[5] ..... H01H 35/02

[52] U.S. Cl. ..... 200/61.52; 200/61.83

[58] Field of Search ..... 200/11 J, 11 K, 16 C, 200/16 D, 61.45 R-61.53, 277, 333, 334, DIG. 29, 61.83

[56] References Cited

U.S. PATENT DOCUMENTS

| | | | |
|---|---|---|---|
| 2,107,570 | 2/1938 | Hobbs | 200/61.83 X |
| 2,198,677 | 4/1940 | Mueller, Sr. | 200/61.52 |
| 2,365,262 | 12/1944 | Gair | 200/61.52 |
| 2,758,195 | 8/1956 | Ludwig | 200/61.52 X |
| 2,997,557 | 8/1961 | Gillmor et al. | 200/61.45 R |
| 3,024,334 | 3/1962 | Johnson | 200/11 K X |
| 3,161,737 | 12/1964 | Hall | 200/61.52 |
| 3,161,738 | 12/1964 | Hall | 200/61.52 |
| 3,217,120 | 11/1965 | Bowen et al. | 200/61.52 |
| 3,294,929 | 12/1966 | Rhodes | 200/11 J |
| 3,629,748 | 12/1971 | Collier et al. | 200/61.52 X |
| 3,733,447 | 5/1973 | Schneider, Jr. | 200/61.52 |
| 3,752,945 | 8/1973 | Achterberg | 200/61.52 X |
| 4,318,245 | 3/1982 | Stowell et al. | 200/61.52 X |
| 4,425,488 | 1/1984 | Moskin et al. | 200/61.52 X |
| 4,503,299 | 3/1985 | Henrard et al. | 200/61.52 |
| 4,751,353 | 6/1988 | Stephens | 200/277 |

*Primary Examiner*—J. R. Scott

*Attorney, Agent, or Firm*—Sandler Greenblum & Bernstein

[57] ABSTRACT

A tilt switch includes a switch casing which confines a chamber therein. First, second and third conductive terminals are provided on sides of the chamber. A movable conductor moves inside the chamber. The switch casing is turnable between a first switch position, wherein gravity acts on the movable conductor so as to place the movable conductor between the first and second conductive terminals to make electrical connection between the first and second conductive terminals, and to break electrical connection between the first and third terminals, and a second switch position, wherein gravity acts on the movable conductor so as to move the movable conductor between the first and third conductive terminals to make an electrical connection and to break electrical connection between the first and second conductive terminals. The movable conductor may include three contacting ball members movable in two communicating chambers.

1 Claim, 5 Drawing Sheets

TILT SWITCH

BACKGROUND OF THE INVENTION

1. Field of the Invention

The invention relates to a switch, more particularly to a tilt switch which is relatively small, is simple in construction and is easy to manufacture.

2. Description of the Related Art

Referring to FIG. 1, a conventional safety switch (A) comprises a switch casing (a) which has upper and lower sides that are respectively provided with switch terminals (b, c). A movable switch contact (d) is provided inside the switch casing (a) between the switch terminals (b, c). The force of gravity which acts on the switch contact (d) is used to pivot the same to connect electrically with one of the switch terminals (b, c).

The safety switch (A) is usually installed in an electrical device, such as an electric fan. When an electric fan incorporating the safety switch (A) is in an upright position, the switch contact (d) electrically connects with the switch terminal (c) so as to achieve a close circuit condition. When the electric fan is accidentally toppled, the switch contact (d) pivots away from the switch terminal (c) so as to connect electrically with the switch terminal (b) and therefore achieve an open circuit condition.

The drawbacks of the above disclosed safety switch (A) are as follows:

1. Note that the safety switch (A) employs a pair of switch terminals (b, c) which are spaced apart so as to permit movement of a switch contact (d). The safety switch (A) is relatively complicated in construction and has a relatively large size. Assembly of the safety switch (A) requires a certain degree of precision so as to ensure proper operation of the same. Attainment of such precision requires expensive machinery and highly experienced workers, thereby increasing the manufacturing costs of the safety switch.

2. The switch contact (d) is pivoted onto the switch casing (a). Rust easily occurs at the pivot joint of the switch contact (d) and can hinder the proper operation of the safety switch (A).

3. The force of gravity is used to move the switch contact (d). If the switch contact (d) is relatively light in weight, effective pressing action of the switch contact (d) against either one of the switch terminals (b, c) cannot be achieved. Breakage of the switch terminals (b, c), however, can easily occur if the switch contact (d) is relatively heavy.

SUMMARY OF THE INVENTION

Therefore, the objective of the present invention is to provide a tilt switch which can overcome the drawbacks associated with the above described conventional safety switch.

More specifically, the objective of the present invention is to provide a tilt switch which is effective yet simple in construction and easy to manufacture.

Another objective of the present invention is to provide a tilt switch which is smaller than the previously described safety switch.

Accordingly, the preferred embodiment of a tilt switch of the present invention comprises:

a switch casing which confines a chamber means therein;

first and second conductive terminals provided on opposite sides of the chamber means; and a movable conductor means disposed inside the chamber means, said switch casing being turnable between a first switch position, wherein gravity acts on the movable conductor means so as to place the movable conductor means between the first and second conductive terminals to make electrical connection between the first and second conductive terminals, and a second switch position, wherein gravity acts on the movable conductor means so as to move the movable conductor means away from the first and second conductive terminals to break electrical connection between the first and second conductive terminals.

BRIEF DESCRIPTION OF THE DRAWINGS

Other features and advantages of the present invention will become apparent in the following detailed description of the preferred embodiments, with reference to the accompanying drawings, of which:

Referring to FIG. 2A, the first preferred embodiment of a tilt switch (1) according to the present invention is shown to comprise a switch casing (10), a conductive terminal set (20) and a movable conductor (30).

Figure 1:
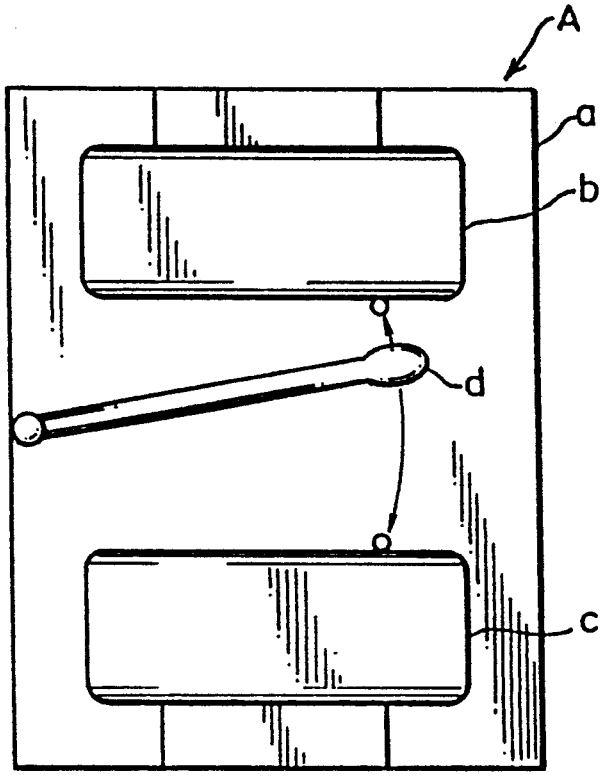
FIG. 1 PRIOR ART
FIG. 1 is a simplified illustration of a conventional tilt switch.

The switch casing (10) confines an elongated chamber (11) therein. The conductive terminal set (20) includes first and second pairs of oppositely disposed conductive terminals (21, 22) which are provided on two sides of the chamber (11). The movable conductor (30) is a ball member which is movably provided in the chamber (11). The diameter of the movable conductor (30) is preferably equal to the width of the chamber (11) (i.e., the space between the conductive terminals of each conductive terminal pair (21, 22)).

Figure 2A:
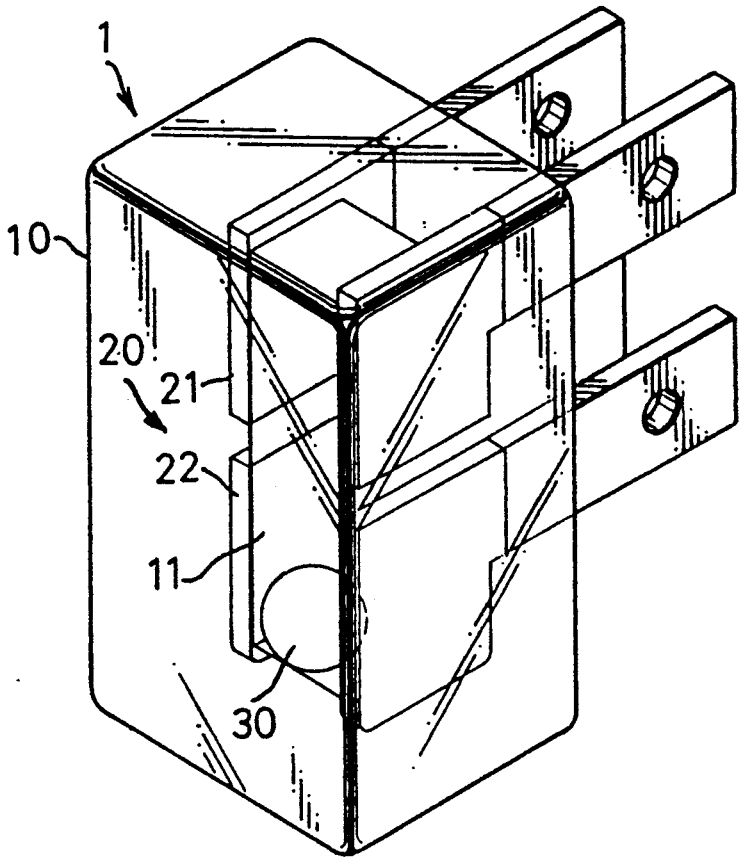
FIG. 2A is an illustration of the first preferred embodiment of a tilt switch according to the present invention.
Figure 2B:
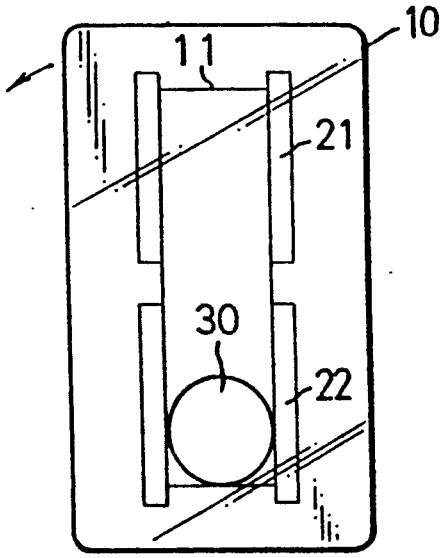
FIGS. 2B, 2C and 2D are illustrations of the first preferred embodiment when operated from a first switch position to a second switch position.
Figure 2C:
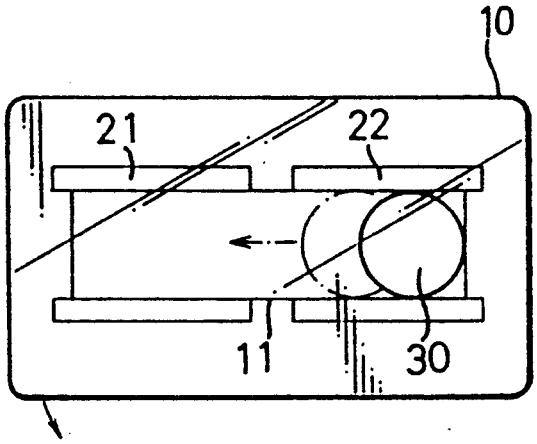
Figure 2D:
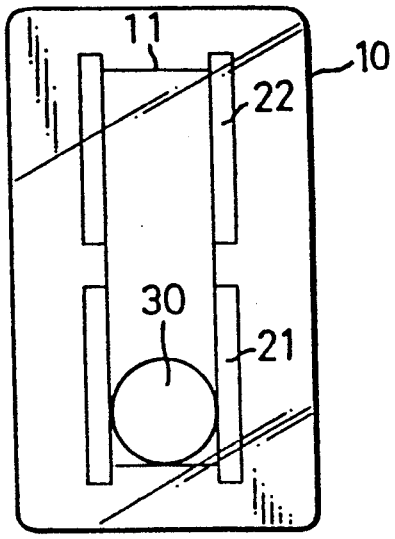

FIGS. 2B, 2C and 2D illustrate the tilt switch (1) when turned counterclockwise from a first switch position to a second switch position. Referring to FIG. 2B, the switch casing (10) should be in a vertically inclining position when installed so that the movable conductor (30) bridges the conductive terminals of the second terminal pair (22) so as to achieve electrical connection between the same when the switch casing (10) is in the first switch position. Turning of the movable conductor (30) from the first switch position to the second switch position, as shown in FIGS. 2C and 2D causes the movable conductor (30) to break electrical connection between the conductive terminals of the second terminal pair (22) and bridge the conductive terminals of the first terminal pair (21) so as to achieve electrical connection between the same. The first and second switch positions can be used to control an electrical device so as to place the same in an ON or OFF state or so as to rotate the same in a clockwise or counterclockwise direction.

The second preferred embodiment of a tilt switch (1*a*) according to the present invention is shown to comprise similarly a switch casing (10*a*), a conductive terminal set (20*a*) and a movable conductor set (30*a*).

The switch casing (10*a*) confines a pair of parallel elongated chambers (11*a*, 11*b*) and has a pair of opposing and inwardly projecting strips (111) which extend between the chambers (11*a*, 11*b*) so as to partition the same. The conductive terminal set (20*a*) includes three conductive terminals (23, 24, 25). The conductive terminal (23) is disposed on one side of the chamber (11*a*) opposite to the strips (111) and extends along the full length of the chamber (11*a*). The conductive terminals (24, 25) are shorter than the conductive terminal (23) and are spaced apart on one side of the chamber (11*b*) opposite to the strips (111). The movable conductor set (30*a*) includes three ball members which are arranged in the chambers (11*a*, 11*b*) such that uppermost and lowermost ones of the ball members are movably disposed in one of the chambers (11*a*) while a middle one of the ball members is movably disposed in the other one of the chambers (11*b*) and is provided between and is in contact with the uppermost and lowermost ones of the ball members. The strips (111) prevent movement of the ball members from one of the chambers (11*a*, 11*b*) to the other.

Figure 3A:
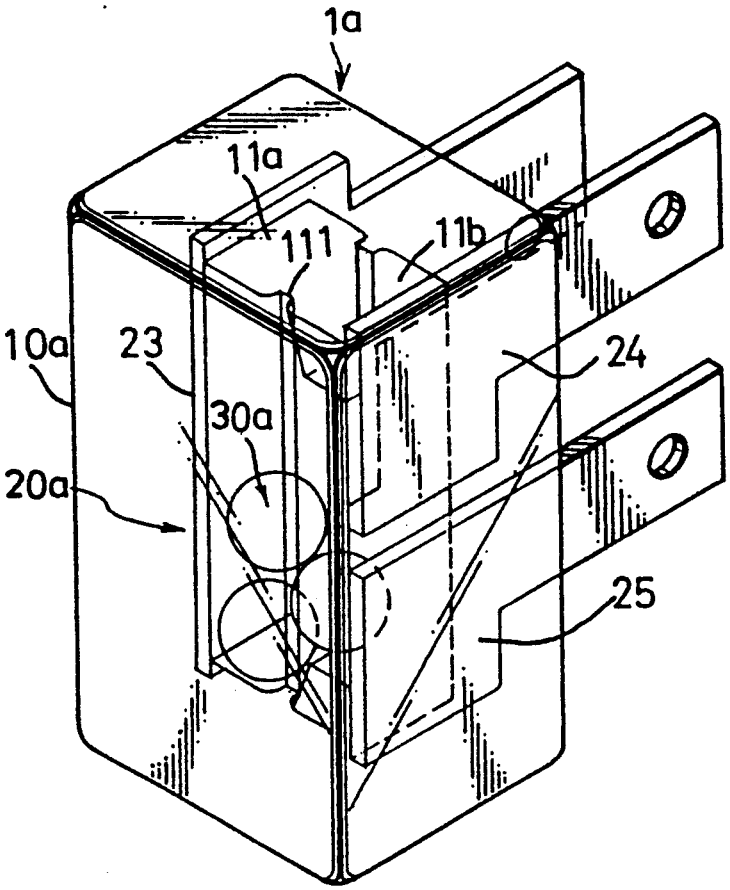
FIG. 3A is an illustration of the second preferred embodiment of a tilt switch according to the present invention.
Figure 3B:
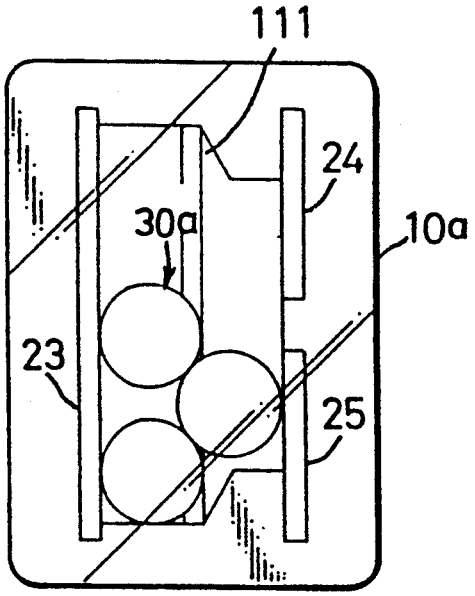
FIGS. 3B and 3C are illustrations of the second preferred embodiment when operated from a first switch position to a second switch position.
Figure 3C:
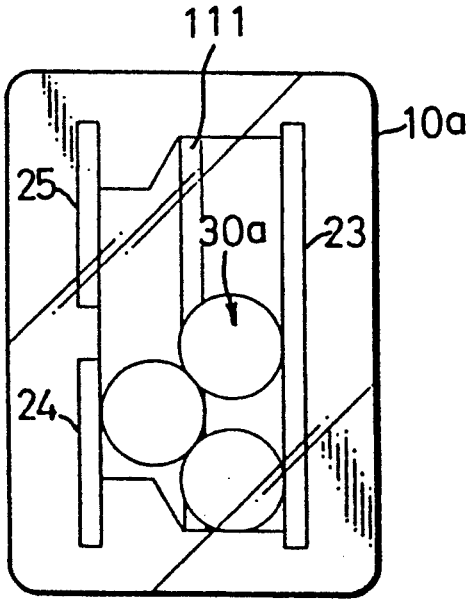

The tilt switch (1*a*) utilizes the force of gravity on the movable conductor set (30*a*) so as to make or break electrical connection between the conductive terminal (23) and one of the conductive terminals (24, 25). FIG. 3B illustrates the tilt switch (1*a*) when in the first switch position. The switch casing (10*a*) should be in a vertically inclining position when installed so that the movable conductor set (30*a*) bridges the conductive terminals (23, 25) to achieve electrical connection between the same. Clockwise (or counterclockwise) turning of the switch casing (10*a*) from the first switch position to the second switch position, as shown in FIG. 3C, causes the movable conductor set (30*a*) to break electrical connection between the conductive terminals (23, 25) and to bridge the conductive terminals (23, 24) so as to achieve electrical connection between the same. As with the first preferred embodiment, the first and second switch positions can be used to control an electrical device so as to place the same in an ON or OFF state or so as to rotate the same in a clockwise or counterclockwise direction.

In summary, the tilt switch of the present invention has a switch casing which confines a chamber. Conductive terminals are provided on two sides of the chamber and a movable conductor makes or breaks electrical connection between the conductive terminals. The rotary switch uses the force of gravity which acts on the movable conductor so as to make or break electrical connection between the conductive terminals whenever the switch casing is turned from a first switch position to a second switch position. The rotary switch of the present invention is relatively small, has a simple construction, and is easy to assemble.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tilt switch comprising:

a switch casing having an elongated chamber means therein, formed by a first inner wall, a second inner wall opposite to said first inner wall, and a pair of opposite third inner walls respectively adjoining said first and second inner walls, at least one of said third inner walls having an intermediate portion which is provided with a longitudinally and inwardly projecting strip, said strip forming a predetermined clearance with the other of said third inner walls and partitioning said chamber means into two parallel communicated chambers;

a first conductive terminal provided on said first inner wall and extending along the full length of said chamber means;

a second conductive terminal provided on said second inner wall;

a third conductive terminal provided on said second inner wall and located adjacent to and spaced from said second conductive terminal; and a movable conductor means inside said chamber means, said movable conductor means including three ball members, first and second of said ball members being movable in one of said chambers, a third of said ball members being movable in the other of said chambers and being provided between said first and second ball members, said three ball members extending into said clearance so as to permit contact between said third ball member and said first and second ball members;

said switch casing being turnable between a first switch position, wherein gravity acts on said movable conductor means so as to place said movable conductor means between said first and second conductive terminals to make an electrical connection between said first and second conductive terminals and to break electrical connection between said first and third conductive terminals, and a second switch position, wherein gravity acts on said movable conductor means so as to place said movable conductor means between said first and third conductive terminals to make electrical connection between said first and third conductive terminals and to break electrical connection between said first and second conductive terminals.

* * * * *